US007836737B2

(12) United States Patent
Lin

(10) Patent No.: US 7,836,737 B2
(45) Date of Patent: Nov. 23, 2010

(54) LOCK FOR PIVOTAL DOORS AND SLIDING DOORS

(75) Inventor: Chung-Liang Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 467 days.

(21) Appl. No.: 12/058,814

(22) Filed: Mar. 31, 2008

(65) Prior Publication Data

US 2009/0243306 A1 Oct. 1, 2009

(51) Int. Cl.
*E05B 63/14* (2006.01)

(52) U.S. Cl. ..... 70/116; 70/134; 70/107; 292/8; 292/27; 292/159

(58) Field of Classification Search ..... 70/95, 70/99, 100, 103, 107, 109, 113, 114, 116, 70/144, 134, 137, 139; 292/5, 8, 24, 27, 292/37, 56, 137, 140, 145, 159, 163
See application file for complete search history.

(56) References Cited

U.S. PATENT DOCUMENTS 471,595 A * 3/1892 Arens ..... 70/134
573,934 A * 12/1896 Trepte ..... 70/131
843,607 A * 2/1907 Hurd ..... 70/134
1,083,173 A * 12/1913 Zeckhauser ..... 292/5
1,168,524 A * 1/1916 Lurie ..... 70/142
1,673,468 A * 6/1928 Palinkas ..... 70/120
2,668,073 A * 2/1954 Collar et al. ..... 292/192
2,720,774 A * 10/1955 Gehrie ..... 70/71
3,175,376 A * 3/1965 Cantwell ..... 70/131
3,360,290 A * 12/1967 De Gray ..... 292/6
3,582,119 A * 6/1971 Woodworth ..... 292/27
3,594,031 A * 7/1971 Ford ..... 292/140
4,050,272 A * 9/1977 Tanaka ..... 70/100
4,239,268 A * 12/1980 Rider ..... 292/5
4,534,191 A * 8/1985 Rogers et al. ..... 70/116
4,566,725 A * 1/1986 Klein ..... 292/191
4,615,550 A * 10/1986 Abate ..... 292/192
5,009,089 A * 4/1991 Lin ..... 70/114
5,516,162 A * 5/1996 Takaishi ..... 292/37
5,529,351 A * 6/1996 Donald ..... 292/254
6,474,118 B2 * 11/2002 Martinez ..... 70/123
6,502,435 B2 * 1/2003 Watts et al. ..... 70/95
6,663,147 B1 * 12/2003 Alban ..... 292/27
7,228,719 B2 * 6/2007 Alchin et al. ..... 70/84

* cited by examiner

*Primary Examiner*—Suzanne D Barrett
(74) *Attorney, Agent, or Firm*—Alan Kamrath; Kamrath & Associates PA

(57) ABSTRACT

A lock includes a case, a key cylinder mounted to an outer side of the case, and a thumb turn mounted to an inner side of the case. A deadbolt is mounted in the case and coupled with a shank of the thumb turn and operably connected to a lock core of the key cylinder. The head is movable along a deadbolt axis between a retracted position in the case and an extended position outside the case when the lock core or the thumb turn is turned. Two hooks are mounted to the deadbolt and each pivotable between a retracted, unlocking position in the case and an extended, locking position outside the case about a pivot axis perpendicular to the deadbolt axis.

5 Claims, 5 Drawing Sheets

LOCK FOR PIVOTAL DOORS AND SLIDING DOORS

BACKGROUND OF THE INVENTION

The present invention relates to a lock and, more particularly, to a lock that can be utilized with both pivotal doors and sliding doors.

Locks for sliding doors generally include one or two hooks pivotable between a retracted, unlocking position and an extended, locking position. Locks for pivotal doors generally include one or more bolts movable in a rectilinear way between a retracted, unlocking position and an extended, locking position. However, locks for sliding doors can not be directly utilized with pivotal locks whereas locks for pivotal doors can not be directly utilized with sliding doors.

A need exists for a lock that can be utilized with not only sliding doors but pivotal doors.

BRIEF SUMMARY OF THE INVENTION

The present invention solves this need and other problems in the field of door locks by providing, in a preferred form, a lock including a case having inner and outer sides and a faceplate extending between the inner and outer sides. A key cylinder is mounted to the outer side of the case and includes a lock core and an actuating member drivable by rotation of the lock core. A thumb turn is rotatably mounted to the inner side of the case and includes a shank. A deadbolt is mounted in the case and includes a head slideably received in an opening of the faceplate and a driving plate fixed to the head. The head is movable along a deadbolt axis between a retracted position in the case and an extended position outside the case. The lock further includes first and second hooks each having first and second ends and a pivotal portion between the first and second ends. The pivotal portion of each hook is pivotably mounted to the head and defines a pivot axis perpendicular to the deadbolt axis. The second end of each hook is pivotable through the opening between a retracted, unlocking position in the case and an extended, locking position outside the case about one of the pivot axes. A pivotal member includes first and second ends and an intermediate portion between the first and second ends thereof. The first end of the pivotal member is coupled with the driving plate to move therewith. The second end of the pivotal member is operably connected to the actuating member. The intermediate portion of the pivotal member is coupled with the shank of the thumb turn to turn therewith. The head is movable between the retracted position and the extended position along the deadbolt axis when the lock core or the thumb turn is turned. The second end of each hook moves together with the head along the deadbolt axis in a first direction and pivots from the retracted, unlocking position to the extended, locking position about one of the pivot axes when the head is moving from the retracted position to the extended position. The second end of each hook moves together with the head along the deadbolt axis in a second direction reverse to the first direction and pivots from the extended, locking position to the retracted, unlocking position about one of the pivot axes when the head is moving from the extended position to the retracted position.

In the most preferred form, the head further includes two holes spaced in a vertical direction perpendicular to the deadbolt axis and perpendicular to the pivot axes. First and second pivots extend through the pivotal portions of the hooks and the holes of the head and form the pivot axes of the first and second hooks. Furthermore, a pin is fixed to the head, and a torsion spring includes first and second tangs and a coil portion mounted around the pin. The tangs abut the pivotal portions of the hooks when the second ends of the hooks are in the retracted, unlocking positions. The tangs press against the first ends of the hooks when the second ends of the hooks are in the extended, locking positions, retaining the second ends of the hooks in the extended, locking positions.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
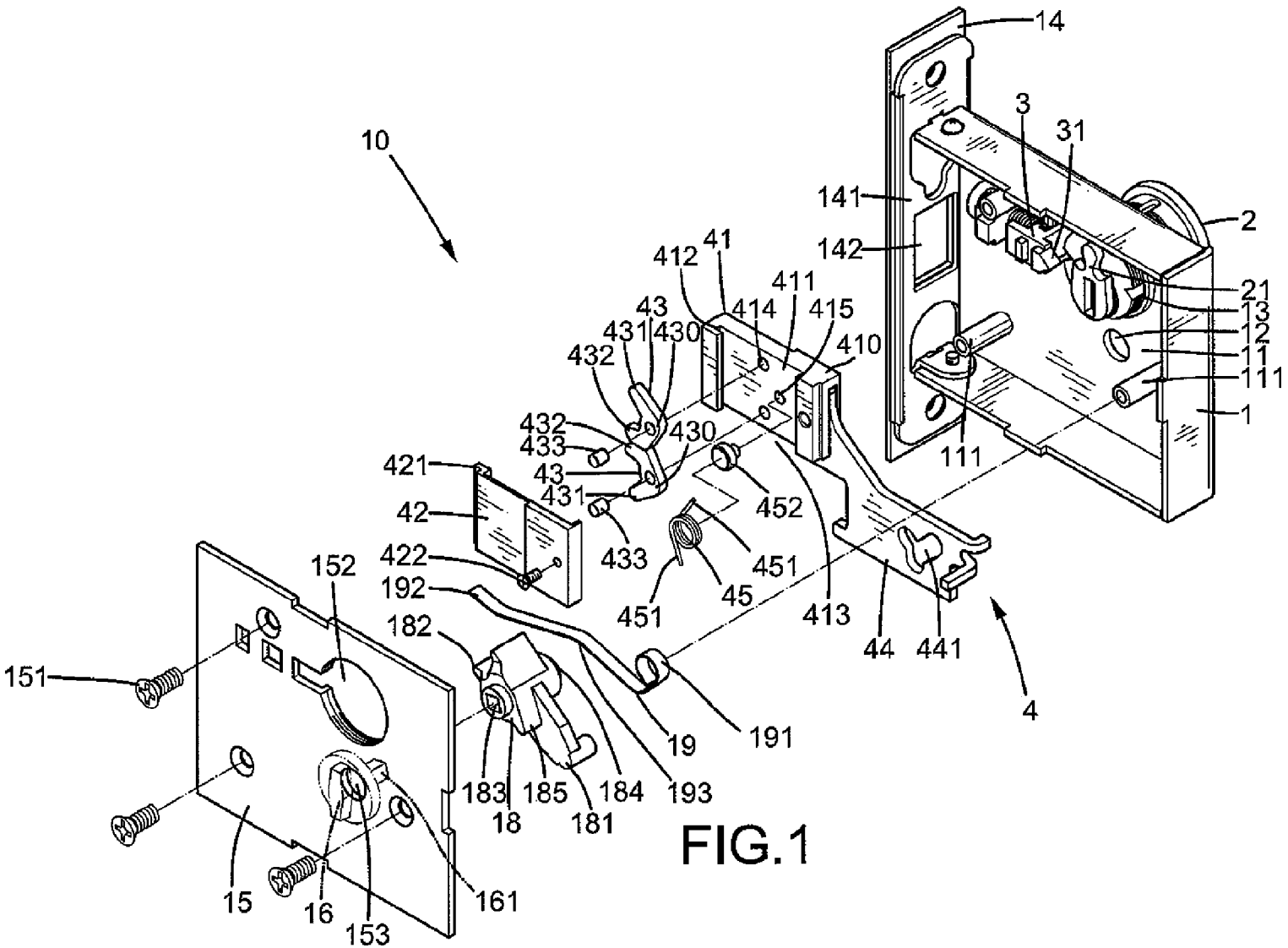
FIG. 1 shows an exploded perspective view of a lock according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "end", "portion", "longitudinal", "axial", "vertical", "outward", "inward", "depth", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A lock according to the preferred teachings of the present invention is shown in the drawings and generally designated 10. According to the preferred form shown, lock 10 includes a case 1 having an open side and defining a compartment 11. A plurality of pegs 111 is formed on an inner face of a side of case 1. Also formed in the side of case 1 are a mounting hole 13 and a pivotal hole 12. Case 1 further includes a faceplate 14 adapted to be mounted to an edge 51 of a door 5 such as a sliding door or a pivotal door, with case 1 received in a compartment 52 of door 5. Faceplate 14 includes an opening 142 communicating an interior of case 1 with the outside. A lid 15 is removably coupled to the open side of case 1 and forms a part of case 1 by extending screws 151 through holes in lid 15 into pegs 111 in case 1. Lid 15 further includes a mounting hole 152 and a pivotal hole 153. A thumb turn 16 includes a shank 161 rotatably extended through pivotal hole 153 of lid 15. Shank 161 has non-circular cross sections. A key cylinder 2 is mounted in mounting hole 13 of case 1 and includes a lock core 22 and an actuating member 21 actuatable by the lock core 22 when a key 23 is inserted into lock core 22 and turned. It can be appreciated that key cylinder 2 can be mounted in mounting hole 152 of lid 15 while thumb turn 16 is mounted in pivotal hole 12 of case 1. In any case, key cylinder 2 is located on an outer side of door 5, and thumb turn 16 is located on an inner side of door 5. A positioning device 3 is mounted in case 1 and includes a hook 31 for preventing undesired rotational movement of key cylinder 2.

According to the preferred form shown, lock 10 further includes a deadbolt 4 having a head 41 movable along a deadbolt axis between a retracted position in case 1 and an extended position outside case 1. Head 41 includes a recessed portion 411 in a side thereof. Recessed portion 411 includes two holes 414 spaced in a vertical direction perpendicular to the deadbolt axis and a pin hole 415. Recessed portion 411 further includes a groove 412 in an end thereof. A side board 42 includes an edge 421 slideably received in groove 412 of head 41. Side board 42 is fixed by a screw 422 to head 41 to cover recessed portion 411, leaving upper and lower openings 413 at upper end lower ends of recessed portion 411. A driving plate 44 is fixed to an inner end 410 of head 41 and includes a coupling slot 441.

According to the preferred form shown, two substantially V-shaped hooks 43 are pivotably mounted to recessed portion 411. Particularly, each hook 43 includes first and second ends 431 and 432 and a pivotal portion 430 between first and second ends 431 and 432. A pivot 433 is extended through pivotal portion 430 of each hook 43 into one of holes 414 and forms a pivot axis perpendicular to the deadbolt axis and perpendicular to the vertical direction. Furthermore, a pin 452 is partially received in pin hole 415 of head 41. A spring 45 in the preferred form shown as a torsion spring has a coil portion mounted around pin 452 and first and second tangs 451.

According to the preferred form shown, lock 10 further includes a pivotal member 18 pivotably received in case 1. Specifically, pivotal member 18 includes a first end 181, a second end 182 in the most preferred form shown as two spaced teeth, and an intermediate portion 184 between first and second ends 181 and 182. Intermediate portion 184 includes a non-circular engaging hole 183 through which shank 161 of thumb turn 16 extends such that pivotal movement of thumb turn 16 causes pivotal movement of pivotal member 18. An arm 185 extends from intermediate portion 184 and is located opposite to first end 181. First end 181 of pivotal member 18 is coupled with coupling slot 441 of driving plate 41. Second end 182 of pivotal member 18 is operably connected to actuating member 21 of key cylinder 2. Furthermore, a resilient plate 19 is mounted in case 1 and includes a first end 191 mounted around one of pegs 111 of case 1, a second end 192 attached to another peg 111 and spaced from first end 191 in a direction parallel to the moving direction of deadbolt 4, and an intermediate portion 193 between first and second ends 191 and 192. Intermediate portion 193 of resilient plate 19 abuts against and retains pivotal member 18 in place.

Now that the basic construction of lock 10 according to the preferred teachings of the present invention has been explained, the operation and some of the advantages of lock 10 can be set forth and appreciated. In particular, for the sake of explanation, it will be assumed that lock 10 is in an unlocking state shown in FIG. 2 wherein head 41 is in the retracted position, and second ends 432 of hooks 43 are in retracted, unlocking positions. Intermediate portion 184 of pivotal member 18 presses against intermediate portion 193 of resilient plate 19 to retain pivotal member 18 in place. Tangs 451 of spring 45 abut pivotal portions 430 of hooks 43.

Figure 2:
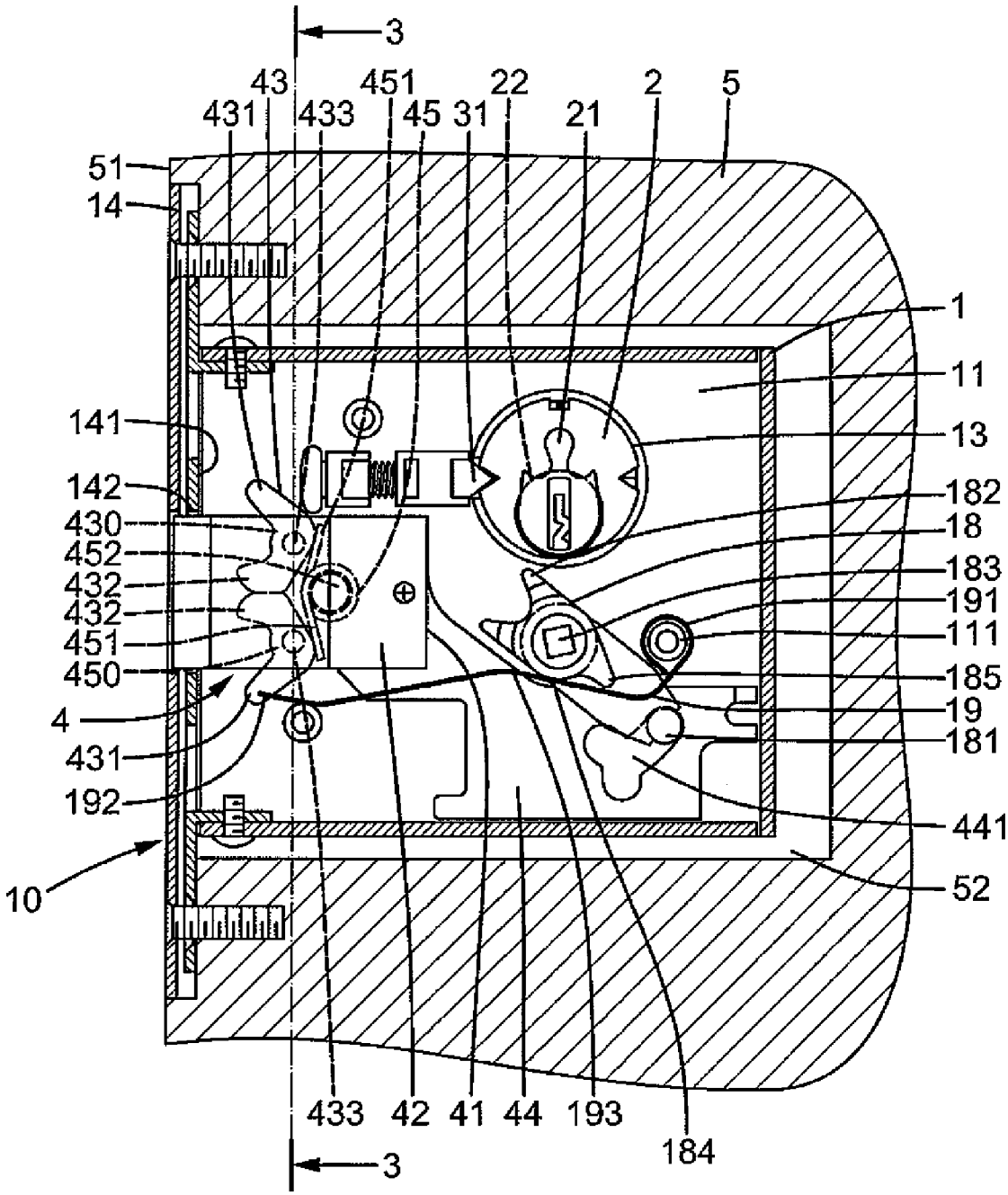
FIG. 2 shows a cross sectional view of the lock of FIG. 1 and a portion of a door to which the lock is mounted, with a deadbolt of the lock in a retracted position and with two hooks of the lock in retracted, unlocking positions.
Figure 3:
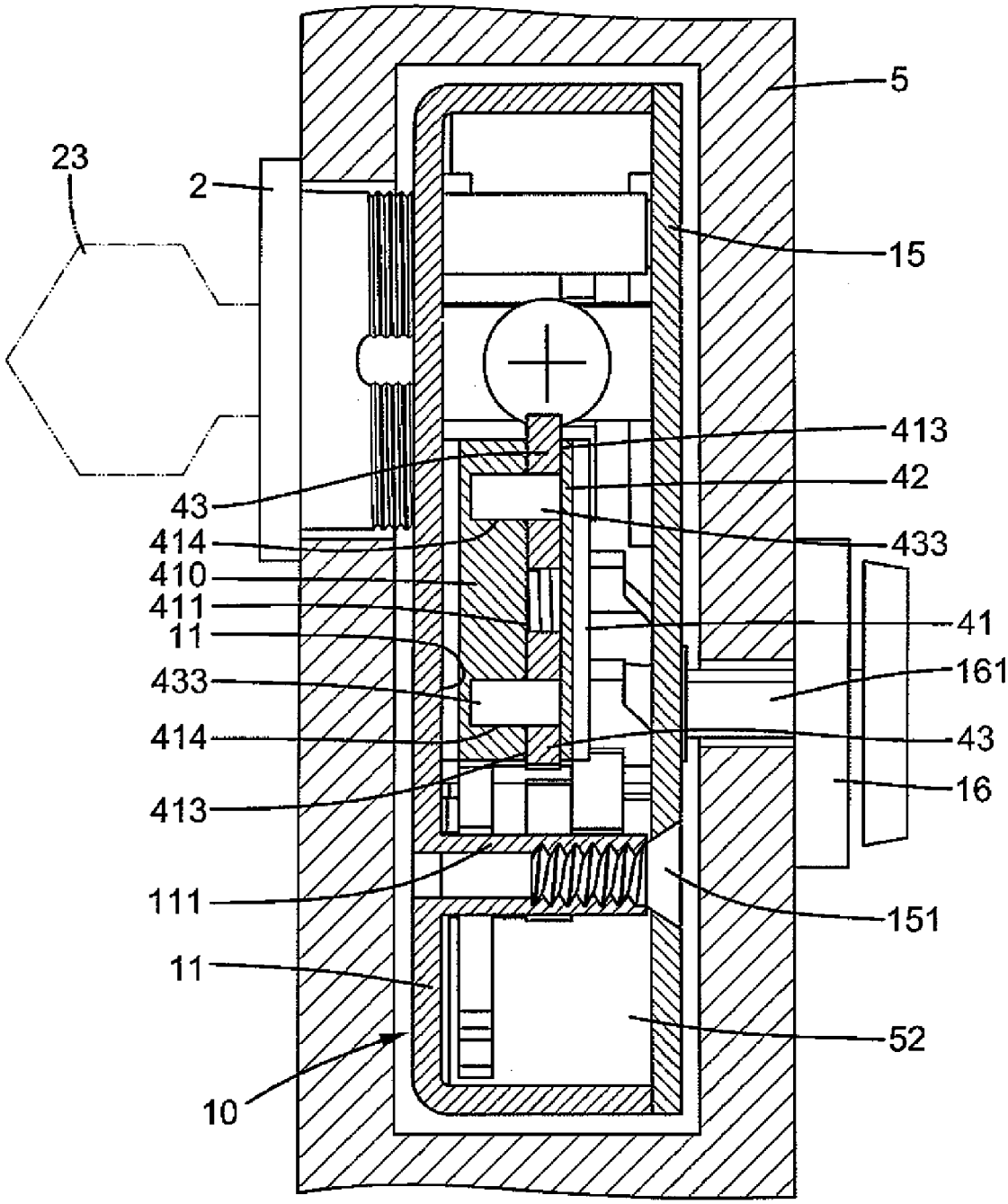
FIG. 3 shows a cross-sectional view of the lock of FIG. 1 and the door of FIG. 2 according to section line 3-3 of FIG. 2.
Figure 4:
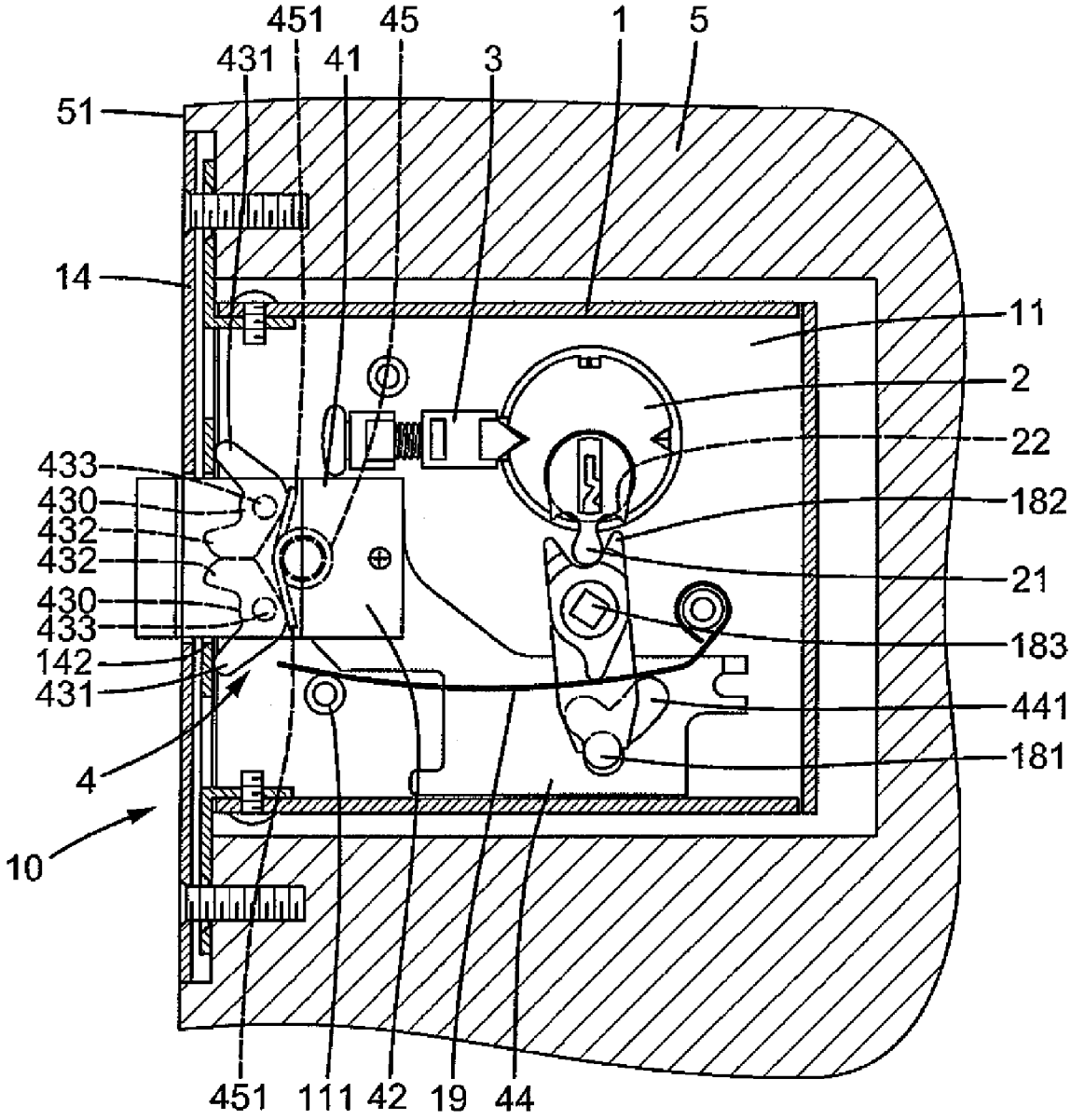
FIG. 4 shows a cross sectional view of the lock of FIG. 1 and the door of FIG. 2 according to section line 3-3 of FIG. 2 with the deadbolt in a semi-extended position and with the hooks in transition positions.
Figure 5:
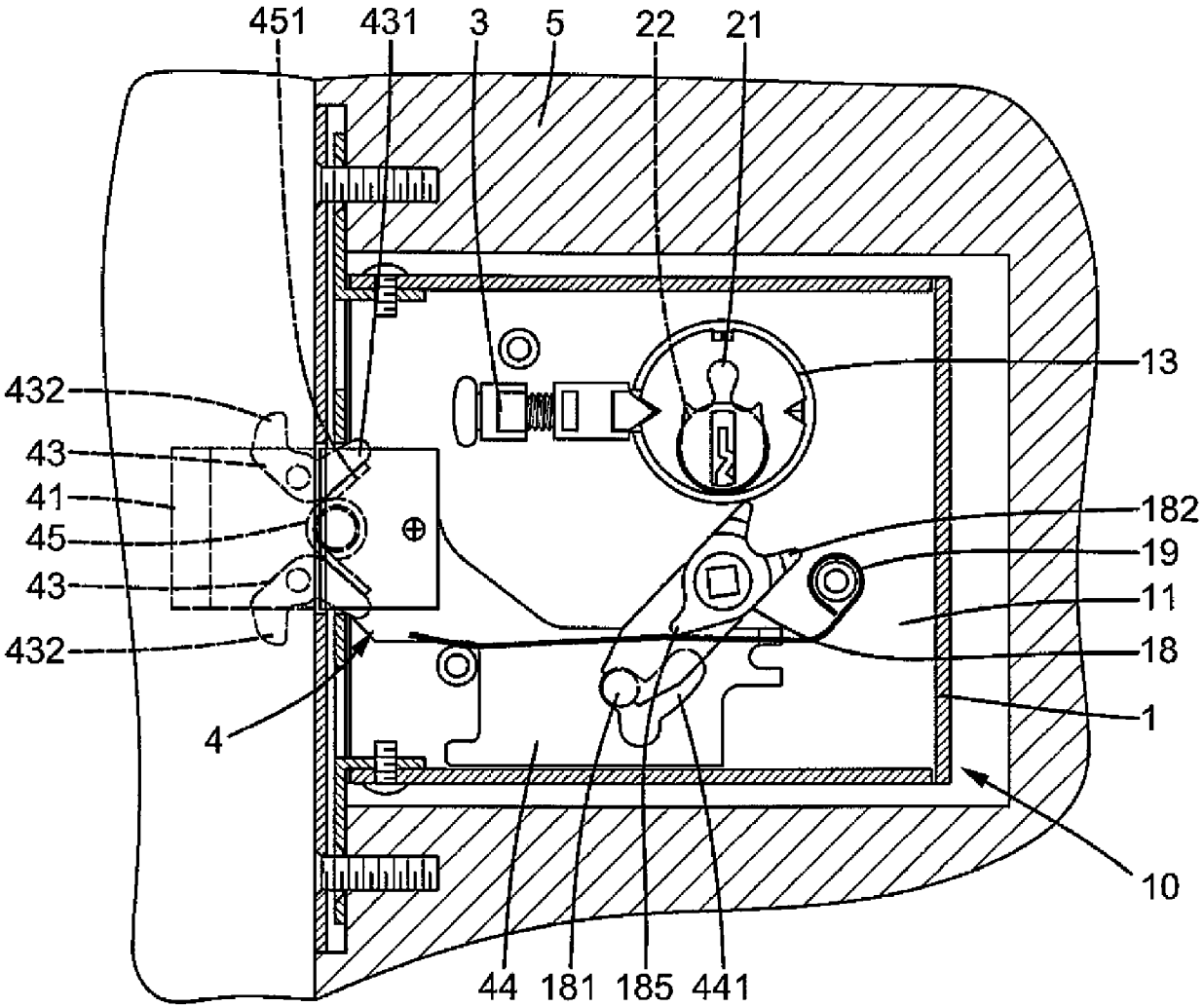
FIG. 5 shows a cross sectional view of the lock of FIG. 1 and the door of FIG. 2 according to section line 3-3 of FIG. 2 with the deadbolt in a fully extended position and with the hooks in extended, locking positions.

For locking purposes, key 23 is inserted into key cylinder 23 and turned in a direction to drive actuating member 21. Pivotal member 18 is pivoted by actuating member 21 to move head 41 of deadbolt 4 out of case 1 (FIG. 4) through opening 142 of faceplate 14 along the deadbolt axis. At the same time, hooks 43 pivot about the pivot axes while moving outward together with head 41 of deadbolt 4 along the deadbolt axis. After first end 431 of each hook 43 comes in contact with inner face 141 of faceplate 14 (FIG. 4), tangs 451 of spring 45 are compressed while second end 432 of each hook 43 is moving outward through one of upper and lower openings 413 of head 41 and through opening 142 of faceplate 14 to the extended, locking position outside case 1 where head 41 of deadbolt 4 is in its fully extended position (FIG. 5). In this state, arm 185 of pivotal member 18 presses against intermediate portion 193 of resilient plate 19 to retain pivotal member 18 in place. Tangs 451 of spring 45 respectively press against pivotal portions 430 of hooks 43 to bias second end 432 of each hook 43 to the extended locking position outside head 41. Key 23 can be turned in a reverse direction to move head 41 of deadbolt 4 to the retracted position in case 1 (FIG. 2) and to move hooks 43 to the retracted, unlocking positions in case 1 (FIG. 2).

A user can turn thumb turn 16 to pivot pivotal member 18 to move head 41 of deadbolt 4 between the retracted and extended positions and to move hooks 43 between the retracted, unlocking position and the extended, locking position. Detailed description of movement of head 41 of deadbolt 4 and hooks 43 is omitted to avoid redundancy.

It can be appreciated that lock 10 according to the preferred teachings of the present invention can be utilized with both pivotal doors and sliding doors. Specifically, head 41 of deadbolt 4 of lock 10 according to the preferred teachings of the present invention acts as a locking member when utilized with a pivotal door, and hooks 43 of lock 10 according to the preferred teachings of the present invention act as locking members when utilized with a sliding door. Only minor modification to a height of a hole in a door jamb to which a striker plate is mounted is required when lock 10 according to the preferred teachings of the present invention is utilized with a pivotal door. On the other hand, only minor modification to a depth for receiving hooks 43 and deadbolt 4 is required when lock 10 according to the preferred teachings of the present invention is utilized with a sliding door. Furthermore, head 41 of deadbolt 4 and hooks 43 of lock 10 according to the preferred teachings of the present invention provide enhanced locking effect. Further, lock 10 according to the preferred teachings of the present invention is simple in structure and, thus, has low costs.

Now that the basic teachings of the present invention have been explained, many extensions and variations will be obvious to one having ordinary skill in the art. For example, groove 412 of head 41 and side board 42 can be omitted. Furthermore, recessed portion 411 of head 41 of deadbolt 4 can be omitted, and hooks 43, pivots 433, and pin 452 can be directly mounted to a side of head 41. Further, driving plate 44 can be integrally formed with head 41 as a single piece.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A lock comprising, in combination:

a case including inner and outer sides, with the case further including a faceplate extending between the inner and outer sides and having an opening;

a key cylinder mounted to the outer side of the case and including a lock core and an actuating member drivable by rotation of the lock core;

a thumb turn rotatably mounted to the inner side of the case and including a shank;

a deadbolt mounted in the case and having a deadbolt axis, with the deadbolt including a head slideably received in the opening of the faceplate and a driving plate fixed to the head, with the head being movable along the deadbolt axis between a retracted position in the case and an extended position outside the case;

first and second hooks each having first and second ends and a pivotal portion between the first and second ends, with the pivotal portion of each of the first and second hooks being pivotably mounted to the head and defining a pivot axis perpendicular to the deadbolt axis, with the second end of each of the first and second hooks being pivotable through the opening between a retracted, unlocking position in the case and an extended, locking position outside the case about one of the pivot axes; and a pivotal member including a first end coupled with the driving plate to move therewith, a second end operably connected to the actuating member, and an intermediate portion between the first and second ends of the pivotal member and coupled with the shank of the thumb turn, with the head being movable between the retracted position and the extended position along the deadbolt axis when the lock core or the thumb turn is turned, with the second end of each of the first and second hooks moving together with the head along the deadbolt axis in a first direction and pivoting from the retracted, unlocking position to the extended, locking position about one of the pivot axes when the head is moving from the retracted position to the extended position, and with the second end of each of the first and second hooks moving together with the head along the deadbolt axis in a second direction reverse to the first direction and pivoting from the extended, locking position to the retracted, unlocking position about one of the pivot axes when the head is moving from the extended position to the retracted position.

2. The lock as claimed in claim 1, further comprising, in combination: a spring mounted to the head and including first and second tangs, with the first tang abutting the pivotal portion of the first hook when the second end of the first hook is in the retracted, unlocking position, with the first tang pressing against the first end of the first hook when the second end of the first hook is in the extended, locking position, retaining the second end of the first hook in the extended, locking position, with the second tang abutting the pivotal portion of the second hook when the second end of the second hook is in the retracted, unlocking position, and with the second tang pressing against the first end of the second hook when the second end of the second hook is in the extended, locking position, retaining the second end of the second hook in the extended, locking position.

3. The lock as claimed in claim 2, with the head further including a pin fixed to a side thereof, and with the spring being a torsion spring having the first and second tangs and a coil portion mounted around the pin.

4. The lock as claimed in claim 3, with the side of the head further including first and second holes spaced in a vertical direction perpendicular to the deadbolt axis and perpendicular to the pivot axes, with the lock further comprising, in combination: first and second pivots extending through the pivotal portions of the first and second hooks and the first and second holes of the side of the head, with the first and second pivots forming the pivot axes of the first and second hooks.

5. The lock as claimed in claim 4, with the side of the head including a recessed portion having the first and second holes, with the recessed portion further including a groove, with the recessed portion further including upper and lower ends, with the lock further comprising, in combination: a side board having an edge slideably received in the groove of the recessed portion; and a screw fixing the side board to the head, covering the recessed portion and leaving upper and lower openings at the upper and lower ends of the recessed portion, with the second end of the first hook being movable through the upper opening, and with the second end of the second hook being movable through the lower opening.

* * * * *